US007549295B2

(12) United States Patent
Gao

(10) Patent No.: US 7,549,295 B2
(45) Date of Patent: Jun. 23, 2009

(54) THREE TRACK VALVE FOR CRYOGENIC REFRIGERATOR

(75) Inventor: Jin Lin Gao, Allentown, PA (US)

(73) Assignees: Sumitomo Heavy Industries, Ltd., Tokyo (JP); SHI-APD Cryogenics, Inc., Allentown, PA (US)

( * ) Notice: Subject to any disclaimer, the term of this patent is extended or adjusted under 35 U.S.C. 154(b) by 478 days.

(21) Appl. No.: 10/580,924

(22) PCT Filed: Feb. 9, 2005

(86) PCT No.: PCT/US2005/004748

§ 371 (c)(1),
(2), (4) Date: May 30, 2006

(87) PCT Pub. No.: WO2005/078363

PCT Pub. Date: Aug. 25, 2005

(65) Prior Publication Data

US 2007/0119189 A1 May 31, 2007

Related U.S. Application Data

(60) Provisional application No. 60/544,144, filed on Feb. 11, 2004.

(51) Int. Cl.
*F25B 9/00* (2006.01)
*F16K 11/074* (2006.01)

(52) U.S. Cl. ..... 62/6; 137/625.46

(58) Field of Classification Search ..... 62/6; 137/625.46

See application file for complete search history.

(56) References Cited

U.S. PATENT DOCUMENTS

| | | | | |
|---|---|---|---|---|
| 3,205,668 | A | 9/1965 | Gifford | |
| 3,237,421 | A | 3/1966 | Gifford | |
| 3,620,029 | A | 11/1971 | Longsworth | |
| 3,625,015 | A | 12/1971 | Chellis | |
| 4,430,863 | A | 2/1984 | Longsworth | |
| 4,987,743 | A | 1/1991 | Lobb | |
| 5,361,588 | A | 11/1994 | Asami | |
| 5,711,156 | A | 1/1998 | Matsui et al. | |
| 5,878,580 | A * | 3/1999 | Schilling et al. | 62/6 |
| 5,974,807 | A * | 11/1999 | Gao et al. | 62/6 |

(Continued)

FOREIGN PATENT DOCUMENTS

| | | |
|---|---|---|
| WO | WO97/08868 | 3/1997 |

OTHER PUBLICATIONS

E. I. Mikulin et al., "Low temperature expansion pulse tubes", Advances in Cryogenic Engineering, vol. 29, 1984, p. 629-637.

(Continued)

*Primary Examiner*—William C Doerrler
(74) *Attorney, Agent, or Firm*—Katten Muchin Rosenman LLP

(57) ABSTRACT

A multi valve two-stage pulse tube type GM refrigerator having a rotary valve that comprises one track for flow to the regenerator and two tracks for flow to the pulse tubes where the valve has two high pressure ports to the pulse tubes located on a single track and two low pressure ports from the pulse tubes located on a separate single track and where there are two cooling cycles per revolution of the rotary face valve.

14 Claims, 2 Drawing Sheets

U.S. PATENT DOCUMENTS

| | | | | |
|---|---|---|---|---|
| 6,256,998 | B1 | 7/2001 | Gao | |
| 6,378,312 | B1 | 4/2002 | Wang | |
| 6,434,947 | B2 * | 8/2002 | Zhu et al. | 62/6 |
| 6,460,349 | B1 | 10/2002 | Kawano et al. | |
| 2003/0089116 | A1 | 5/2003 | Heron | |
| 2004/0094216 | A1 * | 5/2004 | Wagner | 137/625.46 |

OTHER PUBLICATIONS

S. Zhu et al., "Double inlet pulse tube refrigerators: an important improvement", Cryogenics vol. 30, 1990, p. 514-520.

Y. Matsubara, "An experimental and analytical investigation of 4 K pulse tube refrigerator", Proceedings of the 7th International Cryocooler Conference, Air Force Report PL-CP-93-1001, 1993, p. 166-186.

S.W. Zhu et al., "Active-buffer pulse tube refrigerator", Proceedings of the 16th Cryogenic Engineering Conference, 1996, p. 291-294.

J. Huan et al., "A single stage five valve pulse tube refrigerator reaching 32 K", Advances in Cryogenic Engineering, vol. 43, Plenum Press, New York, 1998, p. 1983-1989.

* cited by examiner

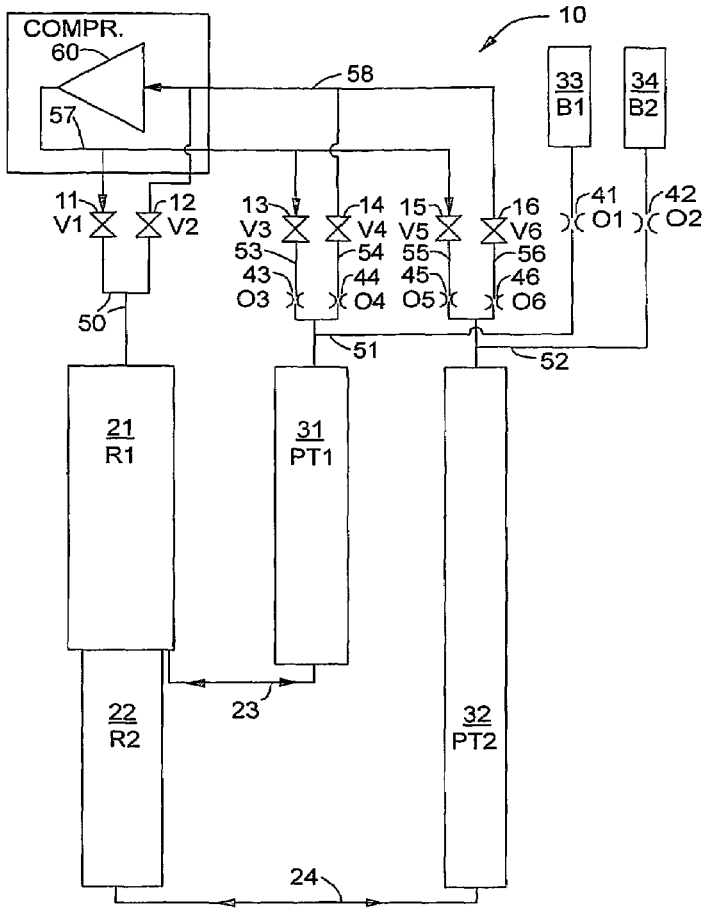
FIG. 1
FIG. 2 Valve timing chart for FIG. 1 pulse tube refrigerator
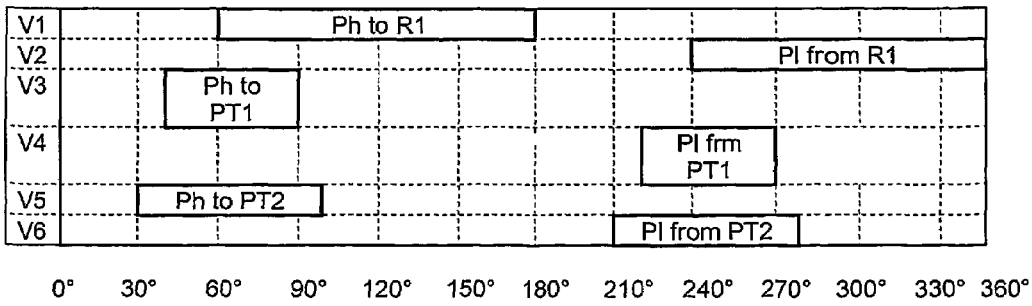

THREE TRACK VALVE FOR CRYOGENIC REFRIGERATOR

This application is the National Stage of International Application No. PCT/US2005/004748, filed Feb. 9, 2005, which claims the benefit under 35 U.S.C. 119 (a-e) of U.S. Provisional Application No. 60/544,144 filed Feb. 11, 2004, which is herein incorporated by reference.

BACKGROUND OF THE INVENTION

The present invention relates to Gifford McMahon (GM) type pulse tube refrigerators. Coldheads of such cryogenic refrigerators include a valve mechanism, which commonly consists of a rotary valve disc and a valve seat. There are discrete ports, which, by periodic alignment of the different ports, allow the passage of a working fluid, supplied by a compressor, to and from the regenerators and working volumes of the coldhead.

GM type refrigerators use compressors that supply gas at a nearly constant high pressure and receive gas at a nearly constant low pressure. The gas is supplied to a reciprocating expander that runs at a low speed relative to the compressor by virtue of a valve mechanism that alternately lets gas in and out of the expander. Gifford, U.S. Pat. No. 3,205,668, discloses a multi-ported rotary disc valve that uses the high to low pressure difference to maintain a tight seal across the face of the valve. This type of valve has been widely used in different types of GM refrigerators as shown for example in Longsworth, U.S. Pat. No. 3,620,029, and Chellis, U.S. Pat. No. 3,625,015. This type of valve has the disadvantage of requiring an increased amount of torque as the diameter is increased to accommodate larger ports or ports for multiple valves.

A Pulse Tube refrigerator was first described by W. E. Gifford in U.S. Pat. No.3,237,421, which shows a pulse tube, connected to valves like the earlier GM refrigerators. It also shows a pulse tube expander connected directly to a compressor so it pulses at the same speed as the compressor. This is equivalent to a Stirling cycle refrigerator.

Early pulse tube refrigerators were not efficient enough to compete with GM type refrigerators. A significant improvement was reported by Mikulin et al. in 1984, (E. I. Mikulin, A. A. Tarasow and M. P. Shkrebyonock, 'Low temperature expansion (orifice type) pulse tube', Advances in Cryogenic Engineering, Vol. 29, 1984, p.629) and a lot of interest ensued in looking for further improvements. Descriptions of major improvements since 1984 can be found in S. Zhu and P. Wu, 'Double inlet pulse tube refrigerators: an important improvement', Cryogenics, vol.30, 1990, p.514; Y. Matsubara, J. L. Gao, K. Tanida, Y. hiresaki and M. Kaneko, 'An experimental and analytical investigation of 4K (four valve) pulse tube refrigerator', Proc. $7^{th}$ Intl Cryocooler Conf., Air Force Report PL-(P-93-101) ,1993, p166-186; S. W. Zhu, Y. Kakami, K. Fujioka and Y. Matsubara, 'Active-buffer pulse tube refrigerator', Proceedings of the $16^{th}$ Cryogenic Engineering Conference, 1997, p. 291-294; and J. Yuan and J. M. Pfotenhauer, 'A single stage five valve pulse tube refrigerator reaching 32K', Advances in Cryogenic Engineering, Vol. 43, 1998, p.1983-1989. Additional disclosure of improvements can be found in Lobb, U.S. Pat. No. 4,987,743.

All of these pulse tubes can run as GM type expanders that use valves to cycle gas in and out of the pulse tube, but only the single and double orifice pulse tubes have been run as Stirling type expanders. Stirling type pulse tubes are small because they operate at relatively high speed. The high speed makes it difficult to get to low temperatures so GM type pulse tubes running at low speed are typically used for applications below about 20 K. It has been found that best performance at 4 K has been obtained with the pulse tube shown in FIG. 9 of Gao, U.S. Pat. No. 6,256,998. This design has two valves controlling flow to the regenerator, and four valves controlling flow to the warm ends of the pulse tubes, which open and close in the sequence shown in FIG. 11 of U.S. Pat. No. 6,256,998. The single stage version of this pulse tube has four valves, two to the regenerator and two to the pulse tube, thus this control is commonly referred to as four-valve control. These valve functions are commonly implemented by the use of a multi-ported rotary disc valve.

When designing a valve that has a disc rotating on a stationary seat it is customary to have one or more ports in the seat that connect to the regenerator, with gas flowing to and from the regenerator through the same ports. While most GM refrigerators use two ports and have two cooling cycles per revolution of the valve disc, three ports have been used, as described in Longsworth, U.S. Pat. No.4,430,863. A single port valve that provides one cycle of cooling per revolution for a GM expander is described in Asami, et al., U.S. Pat. No. 5,361,588. This valve is different from conventional rotary valves in having the high-pressure gas from the compressor act against the valve seat to push it into the face of a rotary valve. A bearing holds the valve disc against the axial force of the valve seat, rather than transferring it as an axial load to the motor shaft. The flow of gas in this arrangement is reversed from the conventional arrangement shown in previous patents. High-pressure gas flows into the center port and low-pressure gas is discharged to the outer perimeter of the valve.

FIG. 11 of U.S. Pat. No. 6,256,998 shows different timing for gas flowing to and from the $2^{nd}$ stage pulse tube, PT2, relative to the $1^{st}$ stage pulse tube, PT1, but it doesn't show another important characteristic of these valves, namely that the size of the orifice in each valve is different. It is necessary to control the amount of gas that flows to each pulse tube and also to have the same amount of gas return to low pressure as flowed in from high pressure. Because the densities are different the orifice sizes in the valve for each pulse tube have to be different.

In a rotary face valve, the ports in the valve seat to the regenerator are on the same diameter circle, or track, because both the high-pressure supply and low-pressure return are connected alternately by the slots in the rotating disc. For a valve disc that has a single cooling cycle per revolution it is necessary to have each of the four ports to the pulse tubes be-on ports-at-different radii, with sufficient radial separation so there is no leakage from one to another. The valve thus has five tracks, one for the flow to and from the regenerator, and four for the flow to and from the pulse tubes. This increases the diameter of the valve and consequently significantly increases the torque.

It is an object of the present invention to reduce the diameter of, and the torque required to turn, a rotary face valve for use in a multi-valve pulse tube.

SUMMARY OF THE INVENTION

This invention reduces the torque required to turn a rotary face valve that is designed for a multi-valve, preferably four-valve, two-stage pulse tube. This is implemented by designing the valve to have two cooling cycles per revolution and to have the two high-pressure ports to the pulse tubes on a single track, and the two low-pressure ports from the pulse tubes on a separate single track. Flow to the regenerator is through two ports while flow to and from the pulse tubes is through one port each in the valve seat. The two high-pressure ports are approximately 180° apart, as are the low pressure ports, and the ports to the $2^{nd}$ stage pulse tube are slotted to increase the open period and advance the opening relative to the $1^{st}$ stage ports. The slots in the valve disc are symmetrical, and have a width that provides the desired open time for the $1^{st}$ stage ports.

Relative to a valve that has one cooling cycle per revolution it reduces the number of tracks from five to three, one being for flow to and from the regenerator, the others for flow to and from the warm ends of the two pulse tubes. The reduction in the number of tracks also reduces the diameter of the valve and the torque required to turn it.

BRIEF DESCRIPTION OF THE DRAWINGS

FIG. 1 is a schematic of a four-valve two-stage pulse tube.

FIG. 2 is a timing chart for the valves shown in FIG. 1.

FIG. 4 is a view of the face of a rotary valve disc to be used with the seat shown in

FIG. 3.

DETAILED DESCRIPTION OF THIS INVENTION

Figure 3:
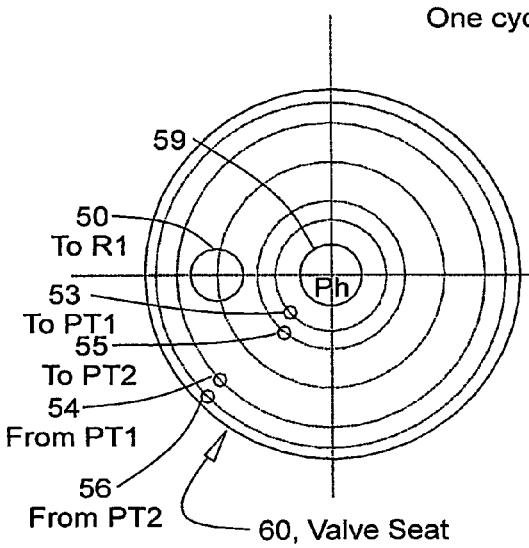
FIG. 3 is a view of the face of a valve seat showing the ports for a four-valve pulse tube that has one cooling cycle per revolution.

The present invention is applicable to a four-valve GM type two-stage pulse tube refrigerator.

FIG. 1 is a schematic of a two-stage four-valve pulse tube refrigerator 10 that shows the gas flow paths through the system. FIG. 1 shows some refinements in the basic two-stage four-valve pulse tube refrigerator that is illustrated in FIG. 9 of U.S. Pat. No. 6,256,998. High-pressure gas, Ph, flows from compressor 60 through gas line 57 to valves 11 (V1), 13 (V3), and 15 (V5). Low-pressure gas, P1, returns to compressor 60 from valves 12 (V2), 14 (V4), and 16 (V6) through line 58. Valves V1 and V2 control the flow to and from regenerator 21 (R1) through line 50. Valve V3 controls the flow to the first stage pulse tube 31 (PT1) through line 53, orifice 43 (O3) and line 51. Valve V53 controls the flow to the second stage pulse tube 32 (PT2) through line 55, orifice 45 (O5) and line 52. Valve V4 controls the flow from PT1 through line 51, orifice 44 (O4) and line 54. Valve V6 controls the flow from PT2 through line 52, orifice 46 (O6) and line 56. Some of the gas that flows in and out of the warm end of PT1 flows through line 51, orifice 41 (O1), and buffer volume 33 (B1). Similarly some of the gas that flows in and out of the warm end of PT2 flows through line 52, orifice 42 (O2), and buffer volume 34 (B2).

The inlet ends of R1, PT1, and PT2 are near ambient temperature while the other ends of PT1 and PT2 get cold as a result of the pulsing of gas into the cold ends after it flows through regenerator R1, regenerator 22 (R2), and connecting tubes 23 and 24. The gas that remains in the pulse tubes can be thought of as gas pistons. Gas flowing into the warm ends of PT1 and PT2 control the motion of the gas piston so that refrigeration is produced at the cold ends. A further description of the operation of a four-valve two-stage pulse tube is contained in U.S. Pat. No. 6,256,998.

The refinements shown in FIG. 1 relative to FIG. 9 of U.S. Pat. No. 6,256,998 are orifices O3, O4, O5, O6, and the division of the buffer volume into two separate volumes, B1 and B2. The orifices preferably are variable and can be adjusted to optimize the cooling during the manufacturing process. Once the optimum size of the flow passages is determined, they can be incorporated into the ports in valves V3, V4, V5, and V6. Splitting the buffer volume into separate volumes for each pulse tube eliminates the possible circulation of gas from one pulse tube to the other through the buffer volume.

FIG. 2 is a timing chart for valves V1 to V6 showing the open periods that have been found to optimize the cooling. It is important to recognize the differences in timing for each of the valves. The object of the present invention is to incorporate these different timings in the design of a single rotary disc type valve.

Figure 4:
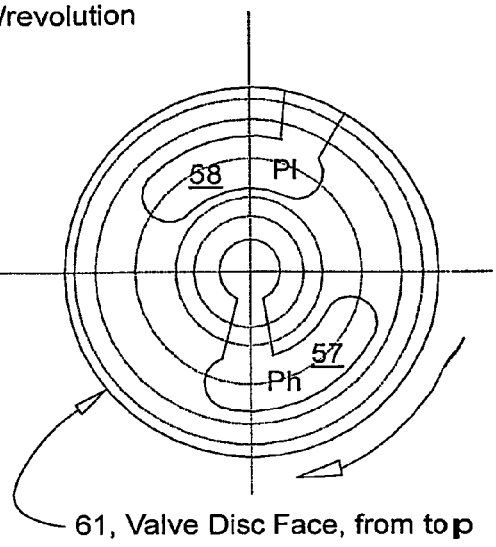

FIGS. 3 and 4 show valve seat 60 which is stationary and valve disc 61 which mates with 60 and provides one cycle of cooling per revolution as the high pressure Ph in slot 57 and low pressure P1 in slot 58 pass over the ports in 60. The slots in the valve disc and the ports in the seat are located in relation to each other so that the timing of FIG. 2 is implemented. Most of the flow to and from the pulse tube passes through R1 thus port 50 for V1 and V2 is much larger than the ports for gas to flow to PT1 through 53, V3, and to PT2 through 55, V5, and for gas to return from PT1 through 54, V4, and PT2 through 56, V6. All five ports are at different radii, or they can be said to be on different tracks, from the axis of rotation of disc 61. FIG. 3 shows ports 53 and 55 that mate with slot 57 as being the same diameter, and ports 54 and 56 that mate with slot 58 as being the same diameter. The timing and duration of port 55, V5, being opened relative to port 53, V3, is achieved by the location of the port and the width of slot 57 as it passes over the ports. Similarly the timing and duration of port 56, V5, being opened relative to port 54, V4, is achieved by the location of the port and the width of slot 58 as it passes over the ports. The valve is shown with high-pressure gas Ph flowing through the center of seat 60 then through slot 57 to ports 50, 53, and 55. Low-pressure gas returns to the compressor through ports 50, 54, and 56, then through slot 58. This flow pattern is preferred to the conventional pattern of having high-pressure gas on the perimeter of the valve and low-pressure gas discharging through the center port in the valve seat because dust that is generated by valve wear tends to be blown to the outside of the valve rather than into the regenerator and flow control orifices.

Figure 5:
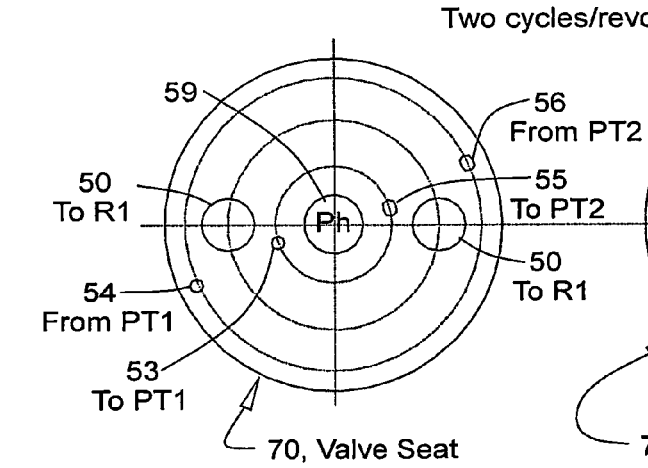
FIG. 5 is a view of the face of a valve seat per this invention showing the ports for a four-valve pulse tube that has two cooling cycles per revolution.
Figure 6:
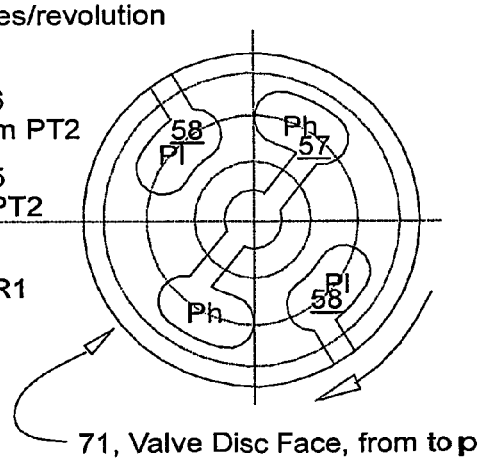
FIG. 6 is a view of the face of a rotary valve disc per this invention to be used with the seat shown in FIG. 5.

FIGS. 5 and 6 show valve seat 70 which is stationary and valve disc 71 which mates with 70 and provides two cycles of cooling per revolution of 71 as the high pressure in slot 57 and low pressure in slots 58 pass over the ports in 70. The novelty of this design lies in the means of reducing the number of tracks for the four ports to/from PT1 and PT2 from four as shown in FIG. 3 to two as shown in FIG. 5. It is possible to have V3 and V5, ports 53 and 55, be open for different periods of time even though slot 57 in valve disc 71 is the same width where it passes over the ports by having one of the ports elongated. In the present example port 55, V5, is elongated relative to port 53, V3. Similarly V4 and V6, ports 54 and 56, can be open for different periods of time even though slots 58 in valve disc 71, where they pass over the ports, are the same width, by having one of the ports elongated. In the present example port 56, V6, is elongated relative to port 54, V4.

While it is preferred that high-pressure gas flows in through the center port and low-pressure gas flows to the outer perimeter it is also possible to design the valve so that the flow is reversed. The essential feature of this invention is to have two high-pressure ports on one track and two low-pressure ports on a second single track, the ports on each track having different open periods.

The invention claimed is:

1. A multi valve two-stage pulse tube type GM refrigerator having a rotary valve that comprises one track for flow to the regenerator and two tracks for flow to the pulse tubes, wherein the valve has two high pressure ports to the pulse tubes located on a single track and two low pressure ports from the pulse tubes located on a separate single track.

2. The multi valve two-stage pulse tube type GM refrigerator of claim 1 further comprising two buffer volumes.

3. The multi valve two-stage pulse tube type GM refrigerator of claim 1 where there are two cooling cycles per revolution of the rotary valve.

4. A three-track rotary valve for use in multi-valve two-stage pulse tube refrigerator where the valve comprises one track for flow to the regenerator and two tracks for flow to the pulse tubes, wherein one track of the three tracks permits flow into the first and second pulse tubes, the second of the three tracks permits flow out of the first and second pulse tubes, and the third track permits flow in and out of the regenerator.

5. A valve in accordance with claim 4 in which the ports to the first pulse tube and the second pulse tube in the valve seat have one of the same opening phase angle relative to the regenerator and a different phase angle.

6. A valve in accordance with claim 4 in which the ports to the first pulse tube and the second pulse tube in the valve seat have one of the same length of time being open and a different length of time.

7. A valve in accordance with claim 5 in which gas flows to the second pulse tube before it flows to the first pulse tube.

8. A valve in accordance with claim 5 in which gas flows from the second pulse tube before it flows from the first pulse tube.

9. A valve in accordance with claim 4 in which gas flows to the second pulse tube for a longer period of time than the first pulse tube.

10. A three-track rotary valve for use in a multi-valve two-stage pulse tube refrigerator, comprising:

one track for flow to the regenerator and two tracks for flow to the pulse tubes, where the valve has two high pressure ports to the pulse tubes located on a single track and two low pressure ports from the pulse tubes located on a separate single track, where there are two cooling cycles per revolution of the rotary face valve, and in which the ports to the first pulse tube and the second pulse tube in the valve seat have one of the same opening phase angle relative to the regenerator and a different phase angle.

11. A valve in accordance with claim 10, in which the ports to the first pulse tube and the second pulse tube in the valve seat have one of the same length of time being open and a different length of time.

12. A valve in accordance with claim 10, in which gas flows to the second pulse tube before it flows from the first pulse tube.

13. A valve in accordance with claim 10, in which gas flows from the second pulse tube before it flows from the first pulse tube.

14. A valve in accordance with claim 10, in which gas flows to the second pulse tube for a longer period of time that the first pulse tube.

* * * * *